US009165486B2

(12) United States Patent
Yu et al.

(10) Patent No.: US 9,165,486 B2
(45) Date of Patent: Oct. 20, 2015

(54) BACK PLATE FOR USE WITH A BACKLIGHT MODULE, A BACKLIGHT MODULE USING THE SAME, AND THE MANUFACTURING METHOD THEREOF

(71) Applicant: AU OPTRONICS CORPORATION, Hsin-Chu (TW)

(72) Inventors: Chiao-Kun Yu, Hsin-Chu (TW); Hung-Chih Chen, Hsin-Chu (TW); Chih-Shun Fan, Hsin-Chu (TW)

(73) Assignee: AU OPTRONICS CORPORATION, Hsinchu-Chu (TW)

( * ) Notice: Subject to any disclaimer, the term of this patent is extended or adjusted under 35 U.S.C. 154(b) by 38 days.

(21) Appl. No.: 13/759,533

(22) Filed: Feb. 5, 2013

(65) Prior Publication Data

US 2013/0258642 A1 Oct. 3, 2013

(30) Foreign Application Priority Data

Mar. 27, 2012 (TW) ..... 101110544 A

(51) Int. Cl.

| | |
|---|---|
| ***F21V 7/04*** | (2006.01) |
| ***G09F 13/04*** | (2006.01) |
| ***B21D 5/00*** | (2006.01) |

(Continued)

(52) U.S. Cl.

CPC . *G09F 13/04* (2013.01); *B21B 1/38* (2013.01); *B21D 5/00* (2013.01); *B21D 19/14* (2013.01); *B21D 22/02* (2013.01)

(58) Field of Classification Search

CPC . G02F 1/0102; G02F 1/0105; G02F 1/13333; G02F 1/133308; G02F 1/133603; G02F 2001/133314; G02F 2001/133317; G02F 2001/13332; G09F 13/00; G09F 13/0413; B21D 5/00

USPC ..... 362/632–634; 349/58–59

See application file for complete search history.

(56) References Cited

U.S. PATENT DOCUMENTS

| | | | | |
|---|---|---|---|---|
| 7,864,260 | B2 * | 1/2011 | Lee et al. | 349/58 |
| 7,911,774 | B2 * | 3/2011 | Nakanishi et al. | 349/58 |

(Continued)

FOREIGN PATENT DOCUMENTS

| | | |
|---|---|---|
| CN | 201636705 | 11/2010 |
| CN | 102436085 A | 5/2012 |

(Continued)

OTHER PUBLICATIONS

Taiwan Office Action dated Jul. 25, 2014.

(Continued)

*Primary Examiner* — Jason Moon Han

(74) *Attorney, Agent, or Firm* — McClure, Qualey & Rodack, LLP

(57) ABSTRACT

A back plate for use with a backlight module, a backlight module using the same, and the manufacturing method thereof are provided. The back plate includes a plate body and a side wall. The side wall extends out from the edge of the plate body and includes a wall body and a bending part, wherein the thickness of the wall body is less or equal to 0.12 mm. The bending part is formed by bending a plurality of bending sheets outward from the top of the wall body, wherein the thickness of each bending sheet is less or equal to 0.12 mm. The backlight module includes the back plate and a light source module, wherein the light source module is disposed on the plate body and adjacent to the inner side of the side wall.

11 Claims, 7 Drawing Sheets

(51) Int. Cl.

| | |
|---|---|
| ***B21B 1/38*** | (2006.01) |
| ***B21D 22/02*** | (2006.01) |
| ***B21D 19/14*** | (2006.01) |

(56) References Cited

U.S. PATENT DOCUMENTS

| | | | |
|---|---|---|---|
| 2008/0303971 | A1 | 12/2008 | Lee et al. |
| 2009/0004408 | A1 | 1/2009 | Nakanishi et al. |

FOREIGN PATENT DOCUMENTS

| | | | |
|---|---|---|---|
| TW | 200909928 | A | 3/2009 |
| TW | M364392 | | 9/2009 |
| TW | M379080 | | 4/2010 |
| TW | M401627 | | 4/2011 |

OTHER PUBLICATIONS

China Office Action dated May 14, 2014.
English translation of abstract of TW M364392 (Sep. 1, 2009).
English translation of abstract of TW M401627 (Apr. 11, 2011).
English translation of abstract of TW M379080 (Apr. 21, 2010).
English translation of abstract of CN 102436085 A (May 2, 2012).
English translation of abstract of CN 201636705 (published Nov. 17, 2010).
China Office Action dated Sep. 3, 2013.

* cited by examiner

BACK PLATE FOR USE WITH A BACKLIGHT MODULE, A BACKLIGHT MODULE USING THE SAME, AND THE MANUFACTURING METHOD THEREOF

BACKGROUND OF THE INVENTION

1. Field of the Invention

This invention generally relates to a back plate for use with a backlight module, a backlight module using the same, and the manufacturing method thereof.

2. Description of the Prior Art

Recently, the demand of LCD displays increases rapidly due to their thin thickness, light weight, high portability, and low radiation with respect to CRT displays. Backlight modules are one of the key components for LCD display panels. With the progress of LCD display manufacturing technique, backlight modules tend to be thinner, higher brightness, and less cost. Developing better backlight modules to make LCD displays with greater competitiveness is a future work trend.

As shown in FIG. 1A, a conventional backlight module includes a metallic back plate 50, a frame 70, a light source module 20, and optical films 30. The metallic back plate 50 is disposed at the bottom of the backlight module. The frame 70 is disposed on the metallic back plate 50 for fixing the light source module 20 and the optical films 30. Light-emitting diodes (LEDs) or light tubes are commonly used as the light source module 20, wherein LEDs are more preferred as the product is advancing to lighter, thinner, and smaller. The optical films may include light guide plate, light enhance film, or other optical films in order to adjust the light outputted by the light source module 20 to attain the design requirement.

Specifications of backlight modules need to be modified in accordance with the size requirement of the final products. More particularly, the thickness of the metallic back plate is decreasing due to the consideration of appearance design and the minimization of product. However, the structure strength of the metallic back plate is also reduced with the decreasing thickness.

SUMMARY OF THE INVENTION

It is an object of the present invention to provide a back plate for use with a backlight module, wherein the side wall of the back plate has greater structure strength.

It is another object of the present invention to provide a backlight module having greater structure strength.

It is another object of the present invention to provide a backlight module back plate manufacturing method, wherein the back plate has greater structure strength.

The back plate of the present invention includes a plate body and a side wall. The side wall extends out from the edge of the plate body. The side wall includes a wall body and a bending part, wherein the thickness of the wall body is less than or equal to 0.12 mm. The bending part is formed by bending outward from the top of the wall body to form a plurality of bending sheets. Each bending sheet overlaps and is parallel to the wall body, wherein the thickness of each bending sheet is less than or equal to 0.12 mm.

The bending part is formed by bending outward from the top of the wall body in the same direction to form the plurality of bending sheets. The bending part is formed by bending outward from the top of the wall body in different directions to form the plurality of bending sheets. A gap is formed between the adjacent bending sheets, wherein the width of the gap is in the range of 0.0125 mm to 0.033 mm.

The side wall is a continuous wall surrounding the plate body. The side wall is a non-continuous wall disposed on at least one side of the plate body. The side wall is a non-continuous wall disposed in pairs on opposite sides of the plate body.

The back plate of the present invention includes a plate body and a side wall extending out from the edge of the plate body. The side wall includes an inner wall body, an outer wall body, and a sandwich layer. The outer wall body is formed by bending the wall body outward from the top of the inner wall body. The sandwich layer is formed by bending the outer wall inward from the other end of the outer wall opposite to the end connected to the inner wall body and is between the inner wall body and the outer wall body. The inner wall body, the sandwich layer, and the outer wall body overlap each other in parallel and respectively have a thickness less than or equal to 0.12 mm.

Gaps are respectively formed between the sandwich layer and the inner wall body and between the sandwich layer and the outer wall body, wherein the width of the gap is in the range of 0.0125 mm to 0.033 mm. The side wall is a continuous wall surrounding the plate body. The side wall is a non-continuous wall disposed on the side of the plate body. The side wall is a non-continuous wall disposed in pairs on opposite sides of the plate body.

The backlight module includes the above mentioned back plate and a light source module. The light source module is disposed on the plate body and is adjacent to the inner side of the side wall.

The backlight module back plate manufacturing method of the present invention includes: forming a side wall at the edge of a plate body, wherein the side wall includes a wall body, wherein the thickness of the side wall is less than or equal to 0.12 mm; and bending the side wall outward to form a bending part overlapping and being parallel to the wall body, wherein the bending part includes a plurality of bending sheets bending outward from the top of the wall body; each bending sheet overlaps and is parallel to the wall body; the thickness of each bending sheet is less than or equal to 0.12 mm.

The bending part can be formed by bending outward from the top of the wall body in the same direction to form the plurality of bending sheets. The bending part also can be formed by bending outward from the top of the wall body in different directions to form the plurality of bending sheets. The bending part can be formed by stamping or rolling up to form the plurality of bending sheets.

DETAILED DESCRIPTION OF THE PREFERRED EMBODIMENT

The present invention provides a back plate for use with a backlight module, a backlight module using the same, and the manufacturing method thereof. In the preferred embodiment, the backlight module is for use with LCD display devices. In different embodiments, however, the backlight module is also available for use with keyboards, mobile phone button panels, billboards, and other devices using flat light source.

Figure 1:
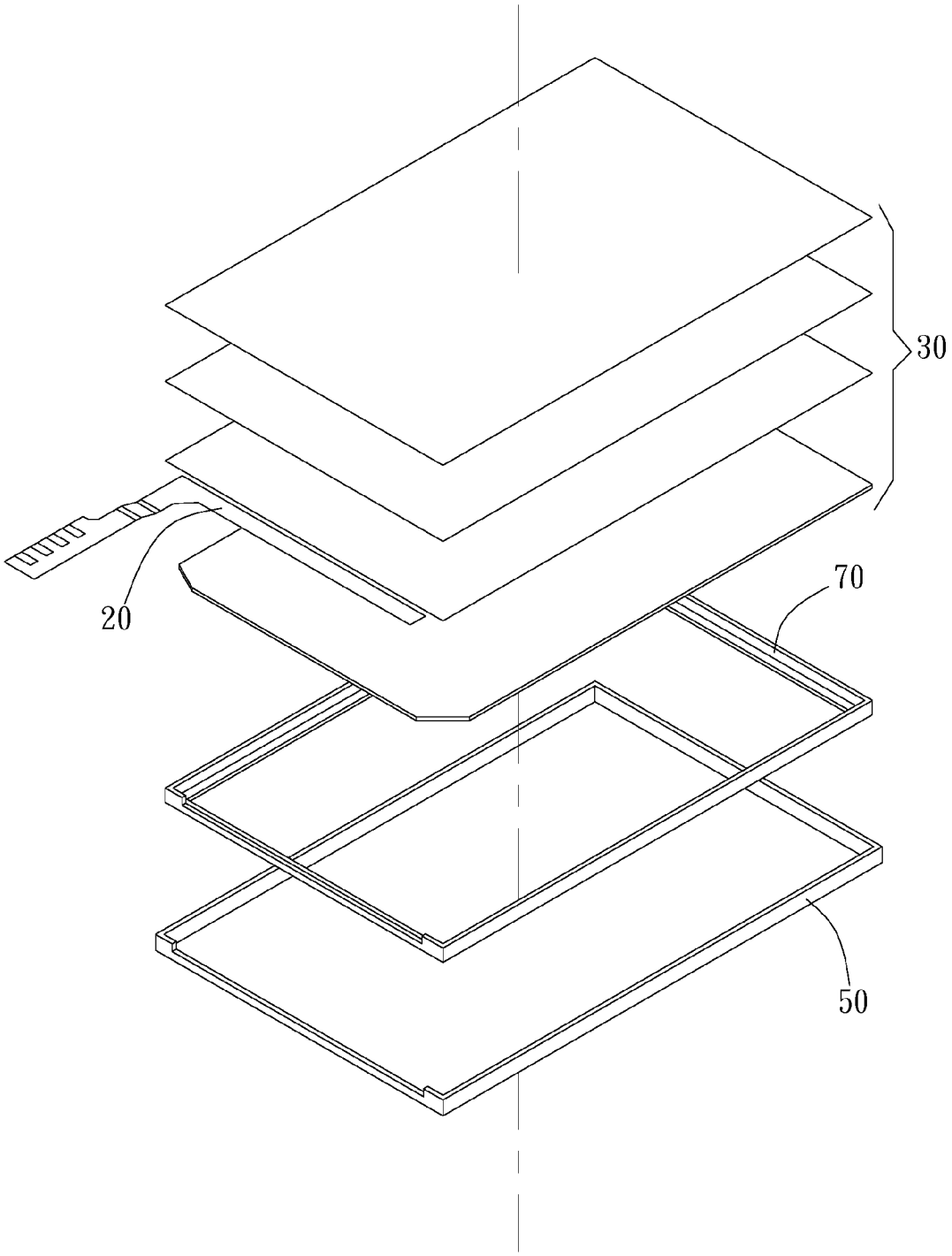
FIG. 1 is a schematic view of the conventional backlight module.
Figure 2:
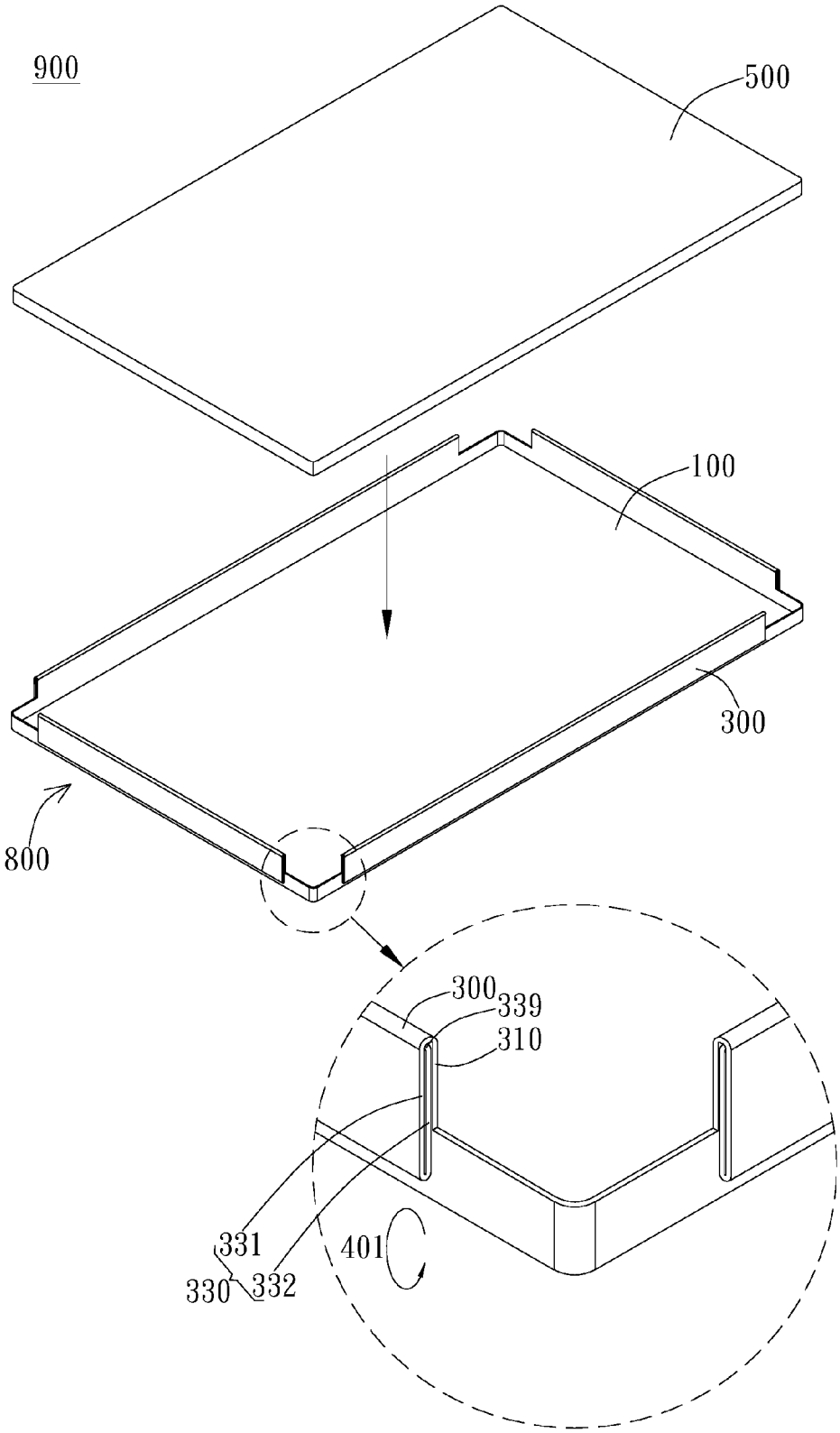
FIG. 2 is a schematic view of the preferred embodiment of the present invention.

As the preferred embodiment shown in FIG. 2, the back plate 800 of the present invention includes a plate body 100 and a side wall 300. The side wall 300 extends out from the edge of the plate body 100. The side wall 300 includes a wall body 310 and a bending part 330, wherein the thickness of the wall body 310 is less than or equal to 0.12 mm. The bending part 330 includes a plurality of bending sheets 331 and 332, which are formed by bending outward from the top of the wall body 310. Each bending sheet overlaps and is parallel to the wall body 310, wherein the thickness of each bending sheet is less than or equal to 0.12 mm. More particularly, as the preferred embodiment shown in FIG. 2, the back plate 800 and the light source module 500 together constitute the backlight module 900. The light source module 500 is disposed on the plate body 100 and is adjacent to the inner side of the side wall 300. The top of the wall body 310 bends outward to form the bending sheets 331 and 332, i.e. bending part 330, in the opposite side of the wall body 310 with respect to the light source module 500. Gaps are respectively formed between the adjacent bending sheets of the same bending part 330, wherein the width of the gap is in a range of 0.0125 mm to 0.033 mm.

As the preferred embodiment shown in FIG. 2, the bending part 330 is formed by bending outward from the top of the wall body 310 in the same direction so that the bending sheets 331 and 332 are formed. More particularly, in the preferred embodiment, the top of the wall body 310 is bent outward along the direction 401 to form the bending sheet 331 first and then bent in the same direction 410 to form the bending sheet 332. The free end 339 of the bending part 330 is disposed between the wall body 310 and the bending sheet 331 that is located further away from the wall body 310. In the different embodiment shown in FIG. 3, however, in order to satisfy the manufacturing or design requirement or to provide shock absorbing ability, the bending part 330 can be formed by bending outward from the top of the wall body 310 in different directions to form the plurality of bending sheets. More particularly, as the embodiment shown in FIG. 3, the top of the wall body 310 is bent outward along the direction 401 to form the bending sheet 331 first and then bent along the direction 402 that is opposite to the direction 401 so as to form the bending sheet 332. In this embodiment, the free end 339 of the bending part 330 is disposed as the most outer portion of the bending part 330.

Figure 4:
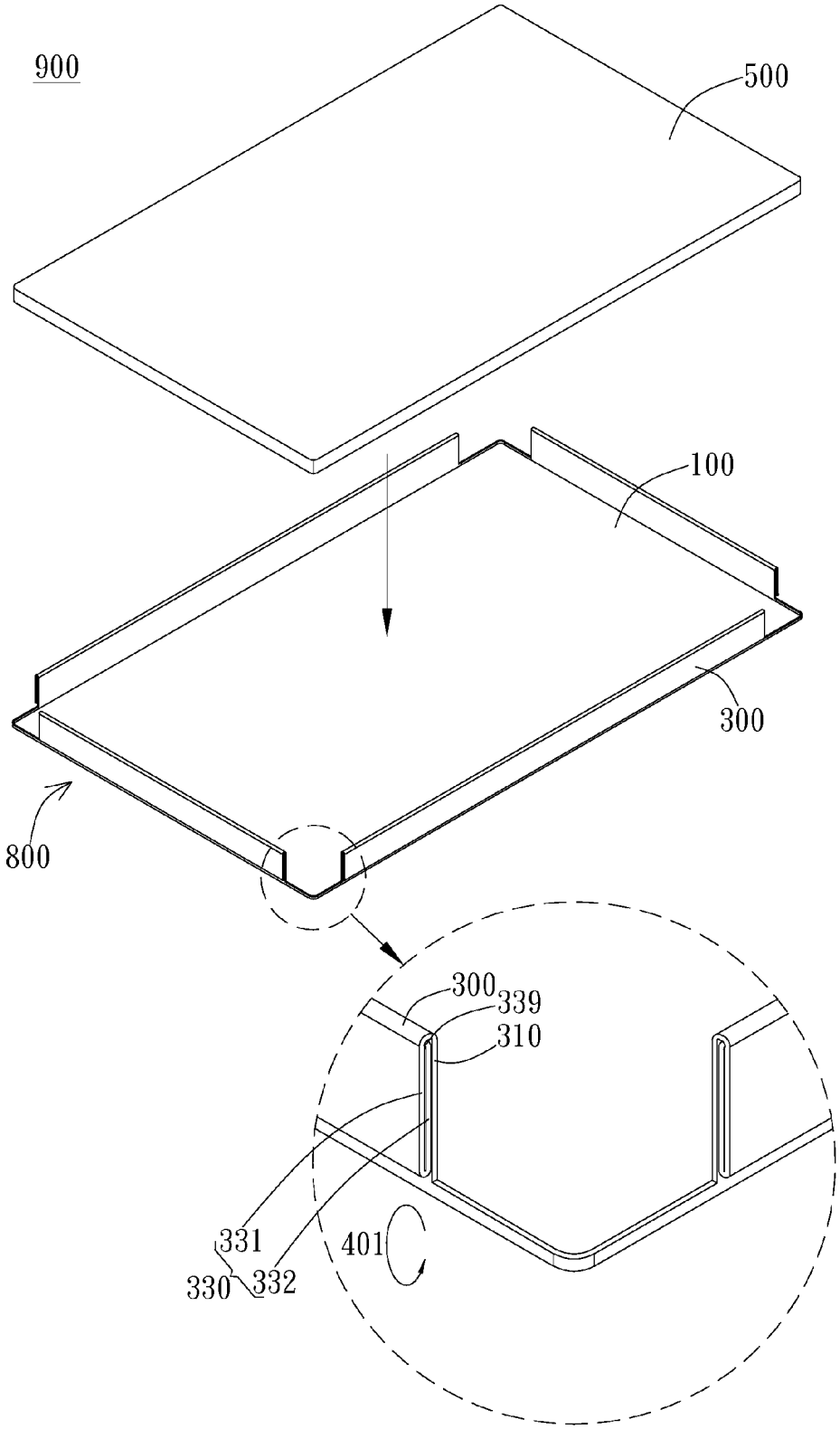
FIG. 4 is a schematic view of the present invention, wherein the side wall is a non-continuous wall disposed in pairs on opposite sides of the plate body.
Figure 5:
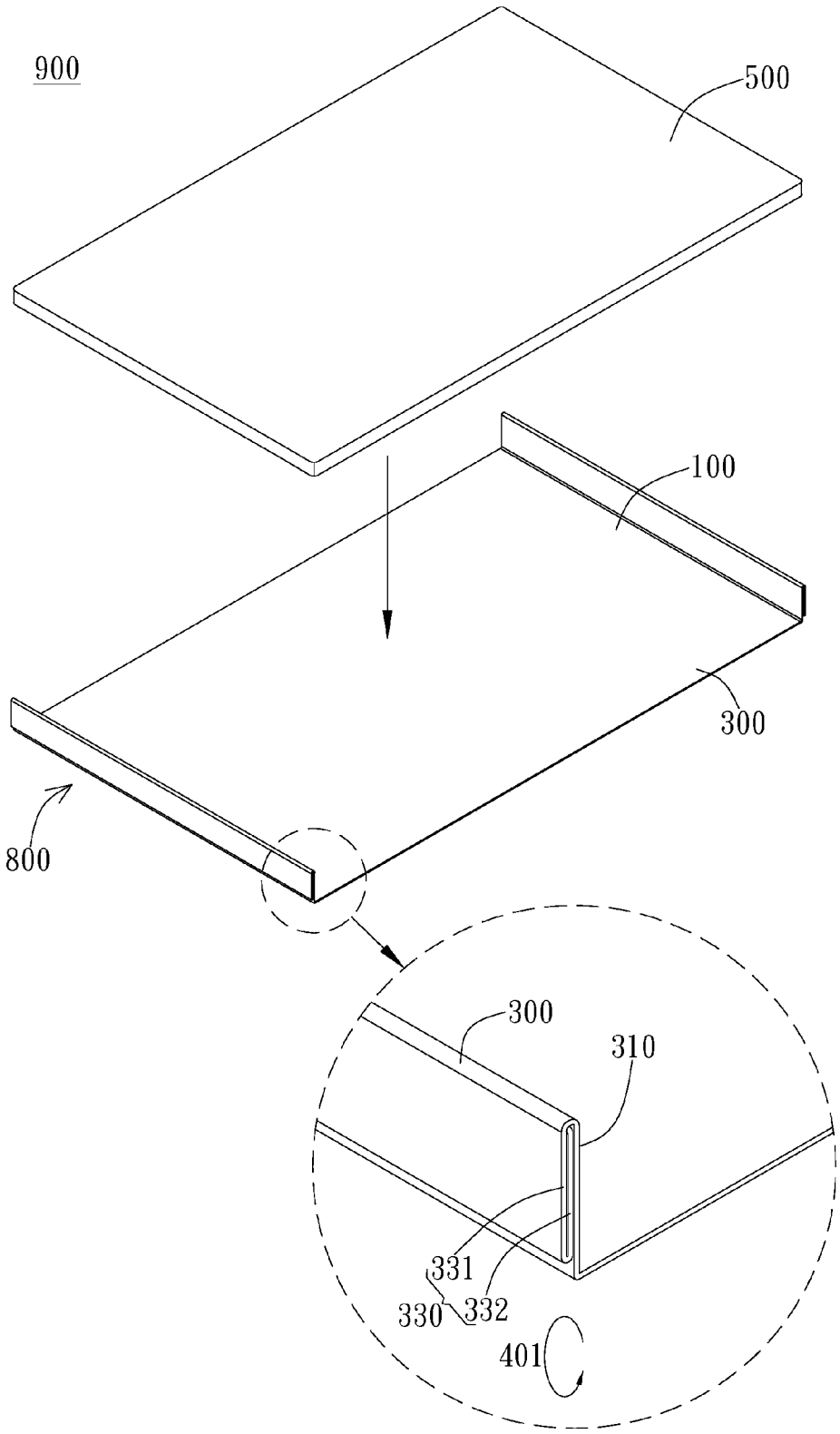
FIG. 5 is a schematic view of the present invention, wherein the side wall is a non-continuous wall individually disposed on the side of the plate body.

As the preferred embodiment shown in FIG. 2, the side wall 300 is a continuous wall surrounding the plate body 100. Accordingly, the structure strength of the back plate 800 can be further enhanced. In different embodiments, however, in order to satisfy the manufacturing or design requirement or to reduce the material cost, the side wall 300 can be a non-continuous wall. As the embodiment shown in FIG. 4, the side wall 300 is a non-continuous wall disposed in pairs on opposite sides of the plate body 100, such as four individual walls disposed apart on four sides of the plate body 100. As the embodiment shown in FIG. 5, the side wall 300 is a non-continuous wall individually disposed on the side of the plate body, such as two walls disposed on two sides of the plate body 100.

Figure 6:
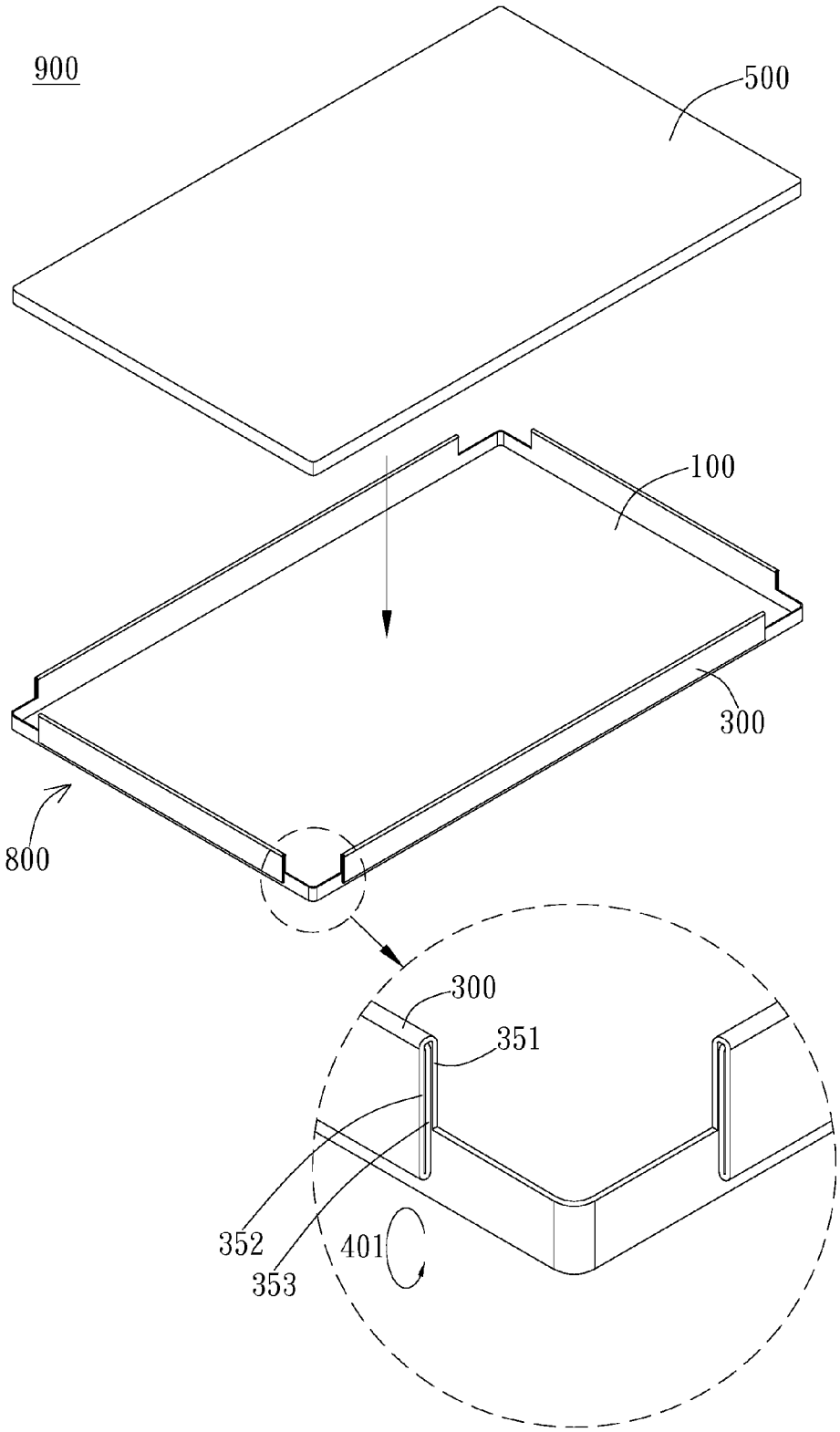
FIG. 6 is another schematic view of the preferred embodiment of the present invention.

As the preferred embodiment shown in FIG. 6, taking a different point of view, the back plate 800 of the present invention includes a plate body 100 and a side wall 300 extending out from the edge of the plate body 100. The side wall 300 includes an inner wall body 351, an outer wall body 352, and a sandwich layer 353. The outer wall body 352 is formed by bending the inner wall body 351 outward from the top of the inner wall body 351. The sandwich layer 353 is formed by bending the outer wall body 352 inward from the other end of the outer wall body 352, which is opposite to the end connected to the inner wall body 351, and is disposed between the inner wall body 351 and the outer wall body 352. The inner wall body 351, the sandwich layer 353, and the outer wall body 352 overlap each other in parallel and respectively have a thickness less than or equal to 0.12 mm. Gaps are respectively formed between the sandwich layer 353 and the inner wall body 351 and between the sandwich layer 353 and the outer wall body 352, wherein the width of the gap is in a range of 0.0125 mm to 0.033 mm.

Figure 7:
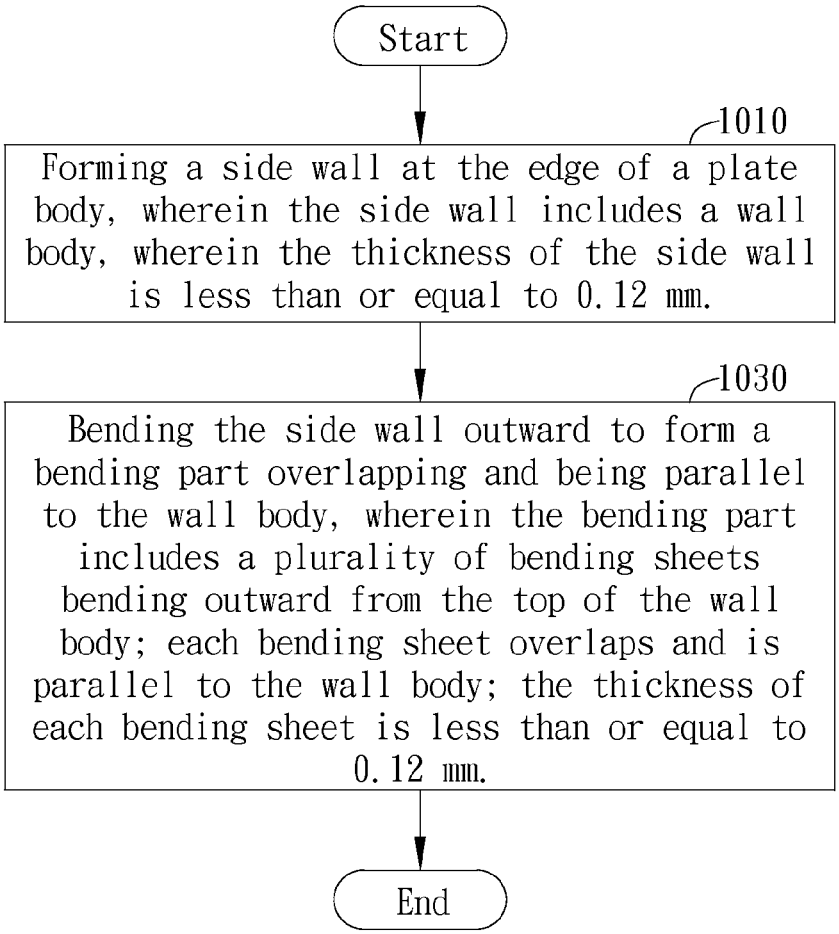
FIG. 7 is a flow chart of the preferred embodiment of the manufacturing method of a back plate of backlight module of the present invention.

As a preferred embodiment shown in FIG. 7, the backlight module back plate manufacturing method of the present invention includes the following steps.

Step 1010 involves forming a side wall at the edge of a plate body, wherein the side wall includes a wall body, wherein the thickness of the side wall is less than or equal to 0.12 mm. More particularly, the plate body 100 having the side wall 300 at the edge as shown in FIG. 2 is formed by extrusion, bending, casting, etc. Considering the convenience for manufacturing, the plate body 100 and the wall body 310 are preferably the same thickness.

Figure 3:
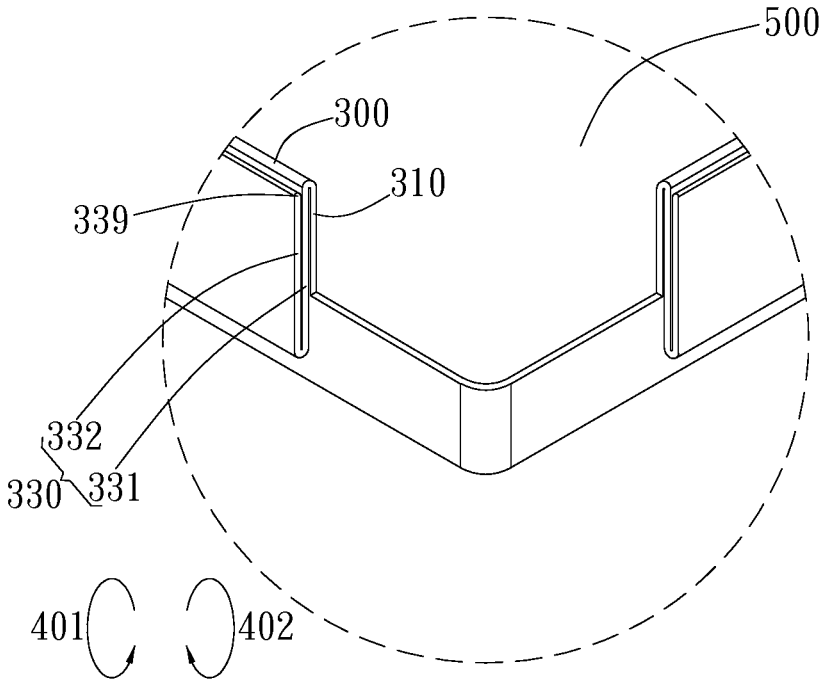
FIG. 3 is a schematic view of an embodiment of the present invention.

Step 1030 involves bending the top of the side wall outward to form a bending part overlapping and being parallel to the wall body, wherein the bending part includes a plurality of bending sheets that are formed by bending outward from the top of the wall body. Each bending sheet overlaps and is parallel to the wall body, wherein the thickness of each bending sheet is less than or equal to 0.12 mm. More particularly, the top end of the wall body 310 of the side wall 300 as shown in FIG. 2 is bent outward to form the bending part 330 overlapping the wall body 310 in parallel by stamping or rolling up. The bending part 330 can be formed by bending outward from the top of the wall body 310 in the same direction to form a plurality of bending sheets, as shown in FIG. 2. The bending part 330 also can be formed by bending outward from the top of the wall body 310 in different directions to form a plurality of bending sheets, as shown in FIG. 3.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A back plate for use with a backlight module, comprising:

a plate body; and a side wall extending out from an edge of the plate body, wherein the side wall includes a wall body and a bending part; the thickness of the wall body is less than or equal to 0.12 mm; the bending part includes a first bending sheet and a second bending sheet, wherein the first bending sheet is formed by bending outward from a top of the wall body, the second bending sheet is formed by bending outward from a bottom of the first bending sheet; each bending sheet overlaps and is parallel to the wall body; the thickness of each bending sheet is less than or equal to 0.12 mm.

2. The back plate of claim 1, wherein a gap is formed between the adjacent bending sheets, and the width of the gap is in a range of 0.0125 mm to 0.033 mm.

3. The back plate of claim 1, wherein the side wall is a continuous wall surrounding the plate body.

4. The back plate of claim 1, wherein the side wall is a non-continuous wall disposed on at least one side of the plate body.

5. The back plate of claim 1, wherein the side wall is a non-continuous wall disposed in pairs on opposite sides of the plate body.

6. A backlight module back plate manufacturing method, comprising:

forming a side wall at an edge of a plate body, wherein the side wall includes a wall body, wherein the thickness of the side wall is less than or equal to 0.12 mm; and bending the side wall outward to form a bending part overlapping and being parallel to the wall body, wherein the bending part includes a first bending sheet and a second bending sheet, wherein the first bending sheet is formed by bending outward from a top of the wall body, the second bending sheet is formed by bending outward from a bottom of the first bending sheet; each bending sheet overlaps and is parallel to the wall body; the thickness of each bending sheet is less than or equal to 0.12 mm.

7. The backlight module back plate manufacturing method of claim 6, wherein the bending part is formed by bending outward from the top of the wall body in different directions to form the plurality of bending sheets.

8. The backlight module back plate manufacturing method of claim 6, wherein the bending part is formed by stamping to form the plurality of bending sheets.

9. The backlight module back plate manufacturing method of claim 6, wherein the bending part is formed by rolling up to form the plurality of bending sheets.

10. A back plate for the use with a backlight module, comprising:

a plate body; and a side wall extending out from an edge of the plate body, wherein the side wall includes a wall body and a bending part; the thickness of the wall body is less than or equal to 0.12 mm; the bending part includes a plurality of bending sheets and is formed by bending outward from a top of the wall body in different directions to form the plurality of bending sheets; each bending sheet overlaps and is parallel to the wall body; the thickness of each bending sheet is less than or equal to 0.12 mm, wherein a gap is formed between the adjacent bending sheets, and the width of the gap is in a range of 0.0125 mm to 0.033 mm.

11. The back plate of claim 10, wherein the side wall is a continuous wall surrounding the plate body.

* * * * *